US006135554A

United States Patent [19]

Tsun et al.

[11] Patent Number: 6,135,554

[45] Date of Patent: Oct. 24, 2000

[54] RECLINER CHAIR

[76] Inventors: Tsai Sung Tsun, No. 908, Nan-Pin Road, West-Castle Village, Ta-Cheng Hsiang, Changhua Country; Shieh Ping, 4F, No. 12, Shian Yan Road, Taipei, both of Taiwan; Bill Harding, Hwy. 15 North, Blue Mountain, Miss. 38610; Julie Huey-Shiang Lee, 77 Citation Crescent, Ancaster, Ontario, Canada, L9K IH8

[21] Appl. No.: 09/131,785

[22] Filed: Aug. 10, 1998

[51] Int. Cl.[7] ..... A47C 1/02

[52] U.S. Cl. ..... 297/327; 297/282; 297/68; 297/328

[58] Field of Search ..... 297/328, 327, 297/326, 325, 276, 281, 282, 68, 313, 259.2, 259.3, 270.3, 270.4, 271.1

[56] References Cited

U.S. PATENT DOCUMENTS

| | | | |
|---|---|---|---|
| 481,119 | 8/1892 | Parks | 297/281 |
| 2,889,152 | 6/1959 | Hurst et al. | 297/327 |
| 3,235,304 | 2/1966 | Glass | 297/327 |
| 4,790,599 | 12/1988 | Goldman | 297/327 |

FOREIGN PATENT DOCUMENTS

| | | | |
|---|---|---|---|
| 14128 | 4/1908 | United Kingdom | 297/328 |

*Primary Examiner*—Laurie K. Cranmer
*Attorney, Agent, or Firm*—Rosenberg, Klein & Lee

[57] ABSTRACT

A recliner chair includes a seat assembly, a pair of spaced-apart side frames having armrests which extend along each side of the seat assembly, a pair of seat supports pivotally suspended from the armrests for supporting the seat assembly and allowing the seat assembly to pivot relative to the side frames, and a pair of locking bars pivotally connected to the armrests at their upper ends and slidably connected to the seat supports at lower portions of the locking bars. The slidable connections are defined by longitudinal slots formed through lower portions of the locking bars, and projecting members mounted on the seat supports and extending through the slots and being engaged by locking controls. The locking controls are actuatable to clamp against the locking bars to prevent relative movement between the locking bars and the seat supports, thus fixing the seat assembly in a selected position.

7 Claims, 5 Drawing Sheets

RECLINER CHAIR

FIELD OF THE INVENTION

The present invention relates to chairs and, more particularly, to recliner chairs permitting a seat assembly to be variably positioned from an upright or sitting position to a reclining position.

BACKGROUND OF THE INVENTION

Recliner chairs provide the ability for the user to vary the angle of a seat assembly, typically between a generally upright sitting position and a reclining position. The motive power for moving the seat assembly from one position to another may be provided by an electric motor or by the user. The present invention relates to recliner chairs that are manually moved by the user.

More specifically, the invention relates to a recliner chair in which a seat assembly of the chair upon which the user sits or reclines is pivotally suspended from a pair of side supports such that the entire seat assembly swings or pivots for adjusting the position thereof between a sitting position and a reclining position.

A recliner chair of the above-described type is known from U.S. Pat. No. 4,790,599 issued to Goldman. The Goldman patent describes a recliner chair including a supporting frame structure having a pair of side members, and a fixed seat structure having a backrest portion, a seat portion, and a footrest portion which are interconnected in a fixed positional relationship with respect to one another. Each of the side members has a raised pivot connecting point, and the seat structure is supported by the pivot points such that the seat swings beneath a pivot axis defined by the pivot points. A trapezoidal-shaped support plate is affixed to each side of the seat structure, and a bar member is welded to each trapezoidal-shaped support plate. Upper ends of the bar members are pivotally connected to pivot pins on the side members of the supporting frame structure. Lower ends of the bar members extend downwardly beyond the support plates to a pair of curved guide members which are connected in fixed positions to the frame side members and extend in a front-to-back direction along the sides of and at a lower vertical level than the lower surface of the seat portion. A rod or bolt is connected to the lower end of each bar member and extends through a curved guide slot in the guide member. The rod or bolt engages a threaded knob. When the user adjusts the position of the seat structure, the rod or bolt slides along the curved guide slot and the guide member provides connecting support and stability to the recliner structure. Once the seat structure is in the desired position, the knobs are tightened to hold the seat structure in position.

In the recliner chair disclosed by Goldman, the knobs are located below the vertical level of the lower surface of the seat portion of the seat structure. Accordingly, a user seated in the chair may find it difficult or awkward to reach the knobs without sitting forward and/or leaning over the side members of the frame structure, particularly if the user has relatively short arms.

SUMMARY OF THE INVENTION

The present invention overcomes the disadvantages of prior recliner chairs noted above, by providing a recliner chair in which user controls for locking the seat assembly of the chair in a desired position are located above the vertical level of the seat portion of the seat assembly so that the controls are easier for the user to reach. The invention includes a unique locking mechanism for locking the seat assembly in a desired position.

More specifically, the invention provides a recliner chair having a pair of side frames which include armrests, a seat assembly located between the side frames and including a backrest, seat, and legrest, and a seat support assembly which is pivotally suspended from the armrests. The seat support assembly includes a pair of seat supports affixed to opposite sides of the seat assembly and pivotally mounted on the armrests. The invention further includes a locking member pivotally mounted on each armrest and extending downwardly into juxtaposed relation to the respective seat support for locking the freely swinging seat assembly in a desired position. To this end, each locking member has an upper end pivotally mounted on the armrest, and a lower portion which is slidably connected to the seat support so as to permit a lengthening or shortening of the effective length of the locking member as the seat assembly is pivoted one way or the other. The slidable connection is located at a higher vertical level than the lower surface of the seat. A locking control is connected to each locking member at the slidable connection thereof and actuatable to immobilize the slidable connection so as to lock the seat assembly in a desired position relative to the side frames. Thus, the locking controls are located such that the user can readily reach them.

In accordance with one preferred embodiment of the invention, the locking members comprise locking bars and the lower portions of the locking bars include longitudinal slots which receive projecting members affixed to the seat supports. As the seat assembly position is adjusted, the projecting members slide within the slots. The locking controls advantageously comprise clamps connected to the projecting members and actuatable to clamp against the locking bars so as to prevent relative movement between the locking bars and the seat supports. The clamps preferably comprise helically threaded members which engage complementary helical threads of the projecting members, and brake members that are compressed against the locking bars when the threaded members are rotated relative to the projecting members.

By providing a recliner chair in which the seat assembly is locked in position by a pair of locking bars pivotally mounted on the armrests and extending downwardly therefrom and slidably connected to the seat supports, the invention provides a recliner chair having the locking controls located at a higher vertical level than the lower surface of the seat, and thus within ready reach of a seat occupant.

BRIEF DESCRIPTION OF THE DRAWINGS

The above and other objects, features, and advantages of the invention will be made more apparent from the following description of a preferred embodiment thereof, when taken in conjunction with the accompanying drawing in which.

DETAILED DESCRIPTION OF THE DRAWINGS

The invention is now explained by reference to a preferred embodiment thereof. It is to be understood, however, that the invention is not limited to the particular details of the preferred embodiment illustrated and described herein.

Figure 1:
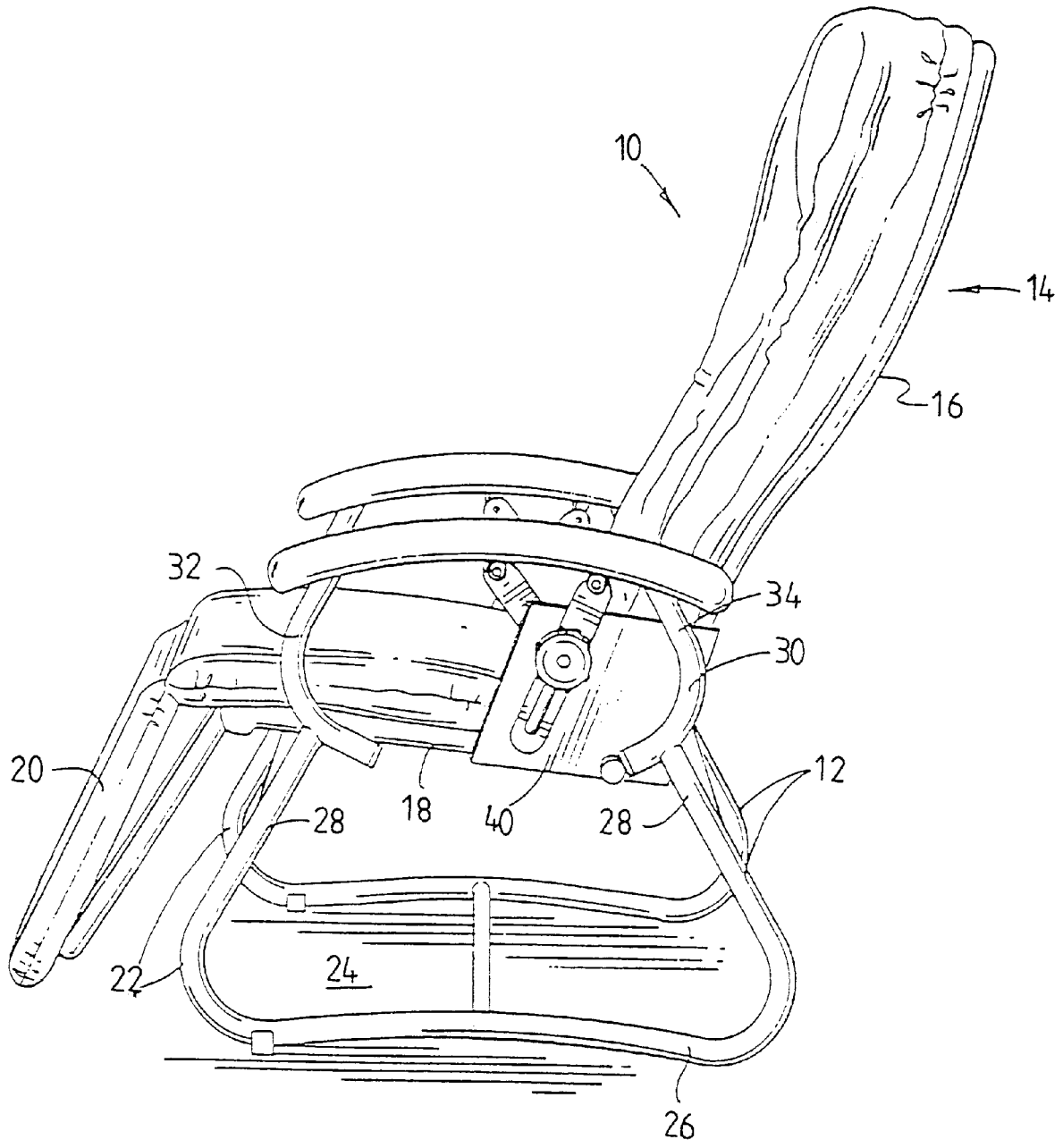
FIG. 1 is a perspective view of a recliner chair in accordance with the invention, showing the seat assembly in an upright sitting position.

With reference to FIG. 1, a recliner chair in accordance with a preferred embodiment of the invention is indicated broadly by the reference numeral 10. The chair 10 includes a pair of side frames 12 which form the supporting structure for the chair. The side frames 12 are connected to opposite sides of a seat assembly 14 of the chair, in a manner described below, so as to permit the seat assembly 14 to be adjusted in position from an upright sitting position to a reclining position. The seat assembly 14 includes a backrest 16, a seat 18 joined at its rear edge to a lower edge of the backrest, and a legrest 20 joined to a forward edge of the seat. In the preferred embodiment of the invention, the backrest 16, seat 18, and legrest 20 are rigidly joined together so that the positional relationship between them remains fixed, and thus the seat assembly 14 comprises a rigid assembly, with the exception of cushioning and upholstery elements which are added to improve comfort and appearance of the chair.

The side frames 12 include leg portions 22 which are adapted to provide a stable support base for the chair upon a supporting surface 24, and which extend vertically upward from the support surface. The leg portions 22 have a truncated triangular shape in side elevation, one side 26 of the triangle resting horizontally on the support surface and the other two sides 28 extending upward from opposite ends of the horizontal side 26. An armrest structure 30 is connected to the upper ends of the sides 28 of each of the leg portions 22.

Each armrest structure 30 comprises front and rear generally vertical curved armrest supports 32 and 34, respectively, which are affixed to the upper ends of the sides 28 of the leg portion 22, and an armrest 36 (FIGS. 2, 4–7) which is affixed to upper ends of the curved armrest supports 32 and 34 and extends generally horizontally in a front-to-rear direction along one side of the seat assembly 14. The armrests 36 are rigid members capable of supporting the weight of the seat assembly 14 and a user seated thereon. The armrests 36 preferably are covered with upholstered pads 38 for improved comfort and appearance.

With primary reference to FIGS. 2–6, the seat assembly 14 is supported by a seat support assembly having a pair of seat supports 40 connected to each side of the seat assembly and pivotally connected to the armrests 36 such that the seat assembly 14 is pivotally suspended from the armrests. The seat support 40 includes an inwardly extending seat ledge 42 for supporting a frame member 44 of the seat 18, and an inwardly extending backrest ledge 46 for supporting a frame member 48 of the backrest 16. The rear end of the seat ledge 42 is joined to the lower end of the backrest ledge 46 to define one corner 50 of the generally rectangular seat support 40. The seat support further includes a pair of elongated bars or plates 52 and 54 affixed to the seat ledge 42 and backrest ledge 46, respectively, and having their free ends affixed to each other to define an opposite corner 56 of the generally rectangular seat support, and a third elongated bar or plate 58 which is affixed to the plates 52 and 54 at the corner 56 and extends diagonally to the corner 50 and is affixed to the seat and backrest ledges thereat. An upper end of the plate 58 is pivotally connected to the armrest 36, as further described below.

The seat support 40 is further reinforced for structural strength and rigidity by a rectangular plate 60 which is rigidly affixed to the three elongated plates 52, 54, and 58, and to the seat and backrest ledges 42 and 46. The plate 60 and ledges 42 and 46 advantageously are integrally formed of one piece, such as by notching a corner of the rectangular plate and bending edge portions of the plate adjacent the notched corner inwardly to form the ledges.

Figure 6:
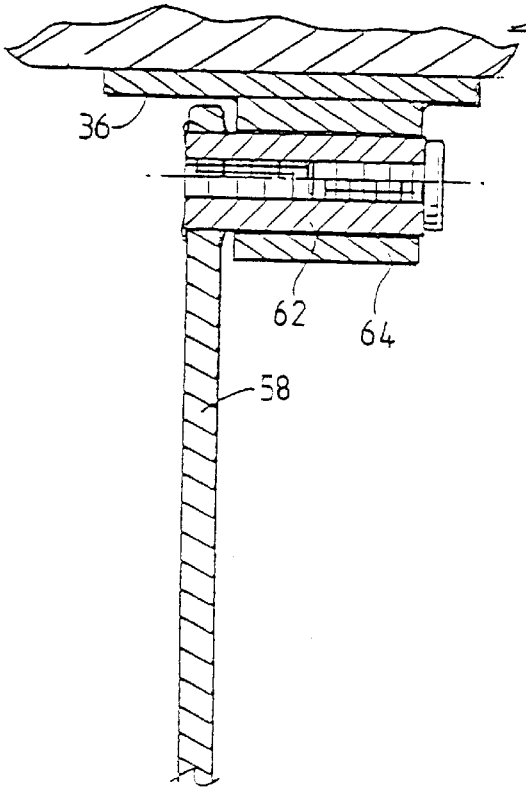
FIG. 6 is a cross-sectional view taken on line 6—6 of FIG. 4, showing details of the pivotal connection between the seat support and the armrest.
Figure 7:
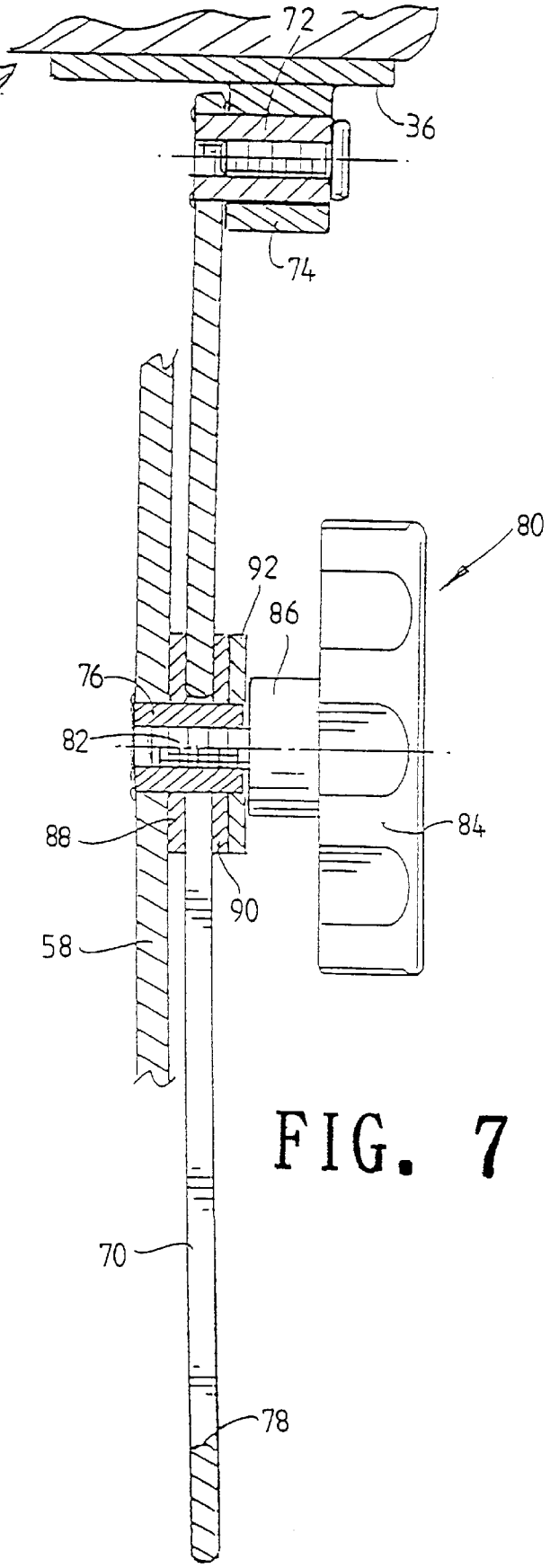
FIG. 7 is a cross-sectional view taken on line 7—7 of FIG. 5, showing details of the pivotal connections between the locking bar and the armrest and seat support, and the locking control for locking the locking bar and seat support together.

As best seen in FIG. 6, the diagonal plate 58 is pivotally connected to the armrest 36 via a pivot pin 62 mounted on the upper end of the plate 58. The pivot pin 62 extends through a pivot bushing 64 which is affixed to the armrest 36. As the seat assembly 14 swings suspended from its pivot members defined by pivot pins 62 and pivot bushings 64, the pivot pins 62 rotate within the pivot bushings 64.

The recliner chair includes locking mechanisms for locking the seat assembly 14 in a desired position relative to the side frames 12. With reference to FIGS. 2–5 and 7, the locking mechanisms comprise a pair of locking bars 70 each of which is pivotally connected at its upper end to one of the armrests 36 via a pivot pin 72 mounted to the upper end of the locking bar 70 and a pivot bushing 74 which is mounted to the armrest 36 and pivotally supports the pivot pin 72. A lower portion of the locking bar 70 is slidably connected to the seat support 40. Specifically, a projecting member 76 is mounted on the diagonal plate 58 and projects outwardly therefrom (i.e., away from the centerline of the chair). The projecting member 76 extends through a longitudinal slot 78 in the locking bar 70 and through a hole (not shown) in the rectangular plate 60 and engages a locking control 80 located adjacent an outer surface of the locking bar. The projecting member 76 is slidable within the slot 78 for permitting a shortening or lengthening of the locking bar's effective length as the seat assembly 14 swings one way or the other relative to the side frames 12. For clarity of illustration, the rectangular plate 60 is not shown in FIGS. 4, 5, and 7.

The locking control 80 is used for immobilizing the slidable connection of the locking bar 70 so that the projecting member 76 is prevented from sliding within the slot 78, thus preventing the seat assembly 14 from pivoting relative to the side frames 12. The locking control 80 comprises a threaded bolt or rod 82 which engages the internally threaded projecting member 76, and a control knob 84 which is affixed to the bolt 82 and includes a cylindrical contact member 86 which confronts the projecting member 76. The locking control 80 further includes a pair of brake members 88 and 90 through which the projecting member 76 extends and which are in contact with the opposite side faces of the locking bar 70. The brake members 88 and 90 are made of a friction material. A washer 92 is sandwiched between the brake member 90 and the cylindrical contact member 86 and is contacted by the contact member 86. Rotating the knob 84 in one direction relative to the projecting member 76 causes the knob and contact member to advance toward the washer 92 and urge the washer 92 against the brake member 90 such that the brake members 88 and 90 and the locking bar 70 are clamped between the washer 92 and the seat support diagonal plate 58. The brake members 88 and 90 are squeezed against the opposite faces of the locking bar 70, thus clamping the locking bar so that it cannot slide relative to the diagonal plate 58. This is the engaged position of the locking mechanism for fixing the seat assembly in a desired position.

Rotating the knob 84 in the opposite direction advances the knob and contact member 86 away from the washer 92, thus loosening the grip on the locking bar 70 and permitting the diagonal plate 58 to slide relative to the locking bar. This is the disengaged position of the locking mechanism. Once the locking controls are in their disengaged positions, the locking bars 70 are free to pivot about their upper pivot points on the armrests.

Thus, a user seated in the seat assembly 14 adjusts the position of the seat assembly by rotating both locking control knobs 84 to their disengaged positions, leaning back or forward to pivot the seat assembly to a desired orientation, and then rotating the knobs 84 to their engaged positions while maintaining the seat assembly in the desired position until the locking bars 70 are firmly clamped by the locking mechanisms.

Figure 2:
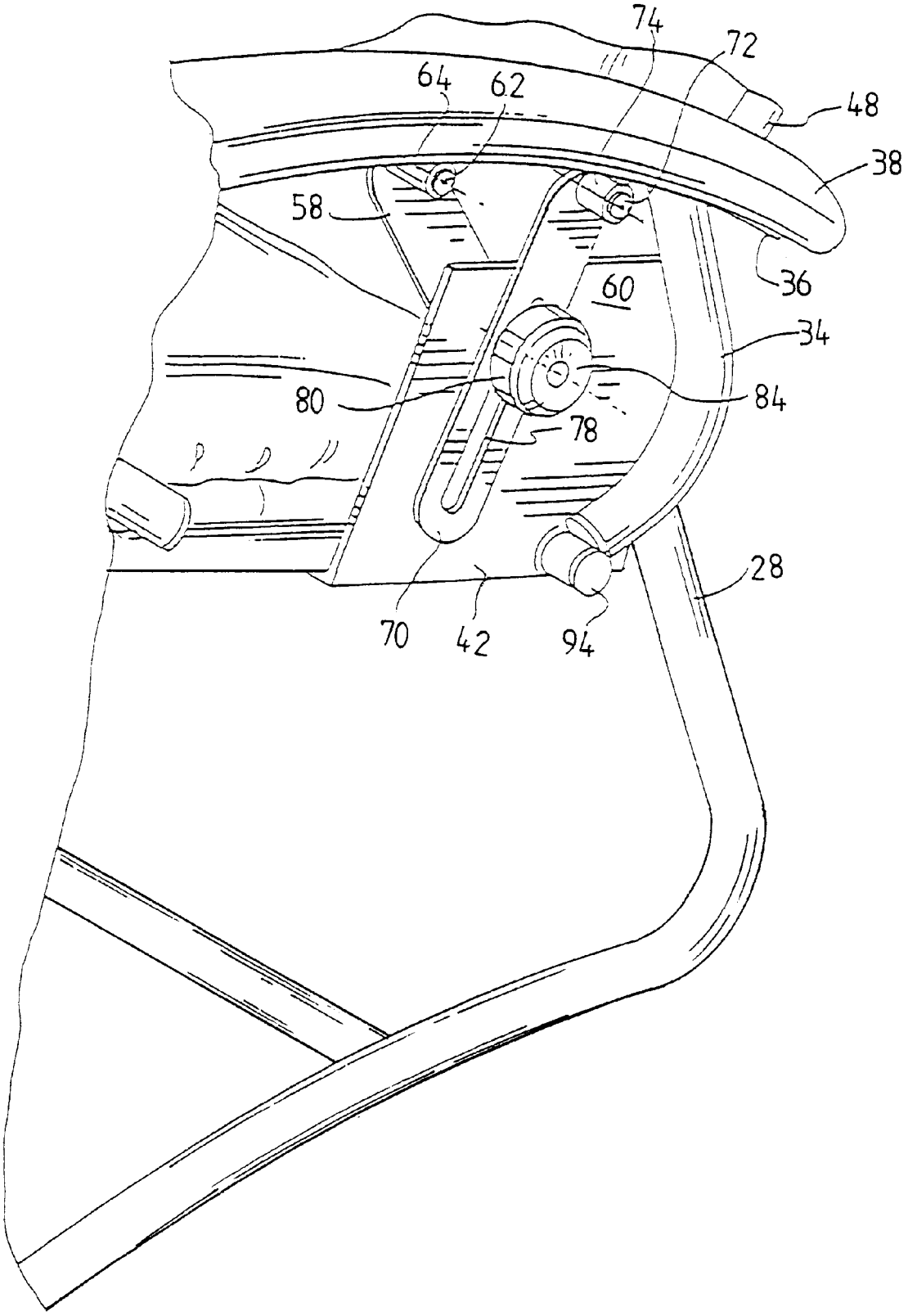
FIG. 2 is a fragmentary perspective view of a locking mechanism and seat support of the chair in a position corresponding to a generally upright position of the seat assembly.
Figure 3:
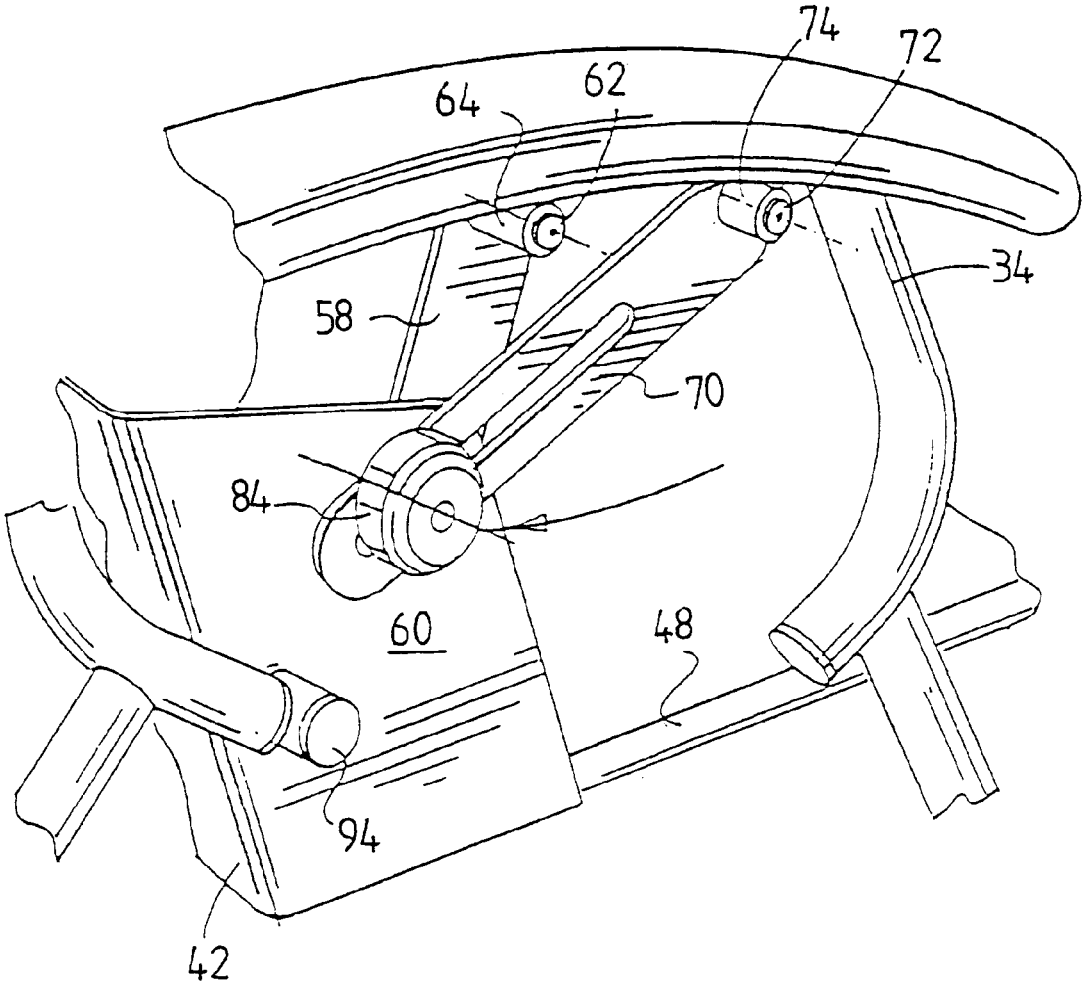
FIG. 3 is a view similar to FIG. 2, showing the locking mechanism and seat support in a position corresponding to a reclining position of the seat assembly.
Figure 4:
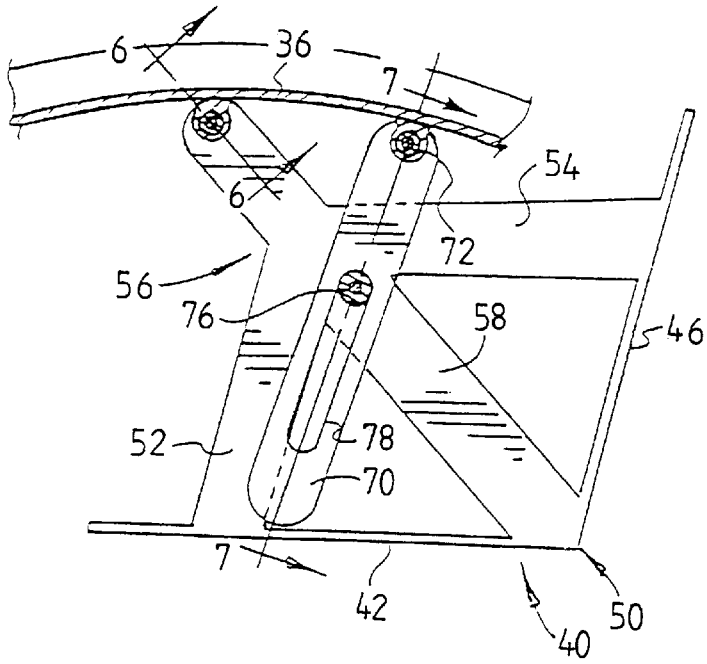
FIG. 4 is a side elevational view, partly in section, of the locking mechanism and seat support in an upright position.
Figure 5:
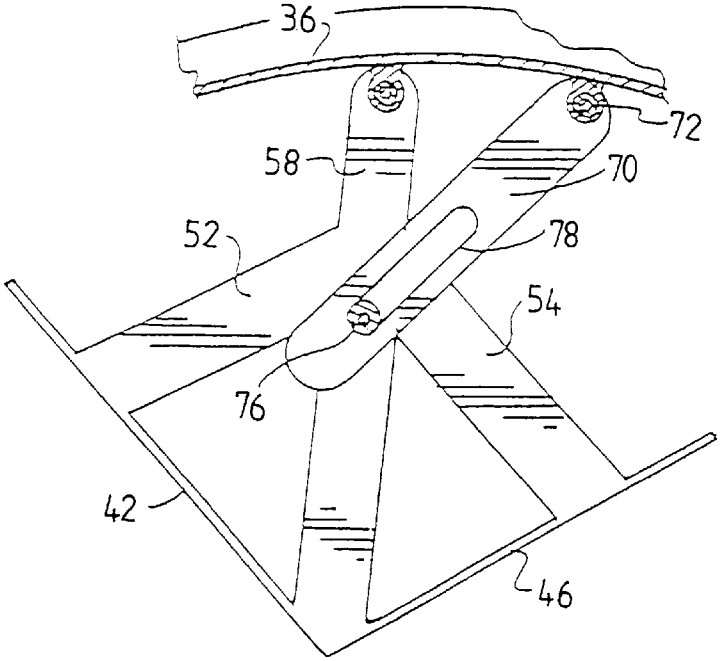
FIG 5 is a view similar to FIG. 4, corresponding to a reclining position.

A seat stop 94 is mounted on each of the rectangular plates 60 for limiting the backward and forward extent of seat movement. The seat stop 94 abuts a lower end of the rear curved armrest support 34 to define the fully upright position of the seat assembly 14, as shown in FIGS. 1 and 2. The seat stop 94 abuts a lower end of the forward curved armrest support 32 to define the fully reclining position of the seat assembly 14, as shown in FIG. 3.

From the foregoing description of a preferred embodiment of the invention, it will be appreciated that the provision of the locking mechanisms having upper pivot points on the armrests 36 and lower pivot points on the seat supports 40 permits the locking control knobs 84 to be located at a higher vertical level than the lower surface of the seat 18. The controls are thereby positioned within ready reach of the seat occupant.

Various modifications and substitutions of equivalents may be made to the preferred embodiment described and illustrated herein without departing from the scope of the invention as set forth in the appended claims. For example, while the-preferred embodiment of the invention described herein employs locking controls in the form of screw-type clamps, other types of clamping devices for clamping the locking bars in a selected position may be used instead, such as cam-type clamps. Other modifications may also be made without departing from the scope of the invention.

What is claimed is:

1. A recliner chair comprising:

a seat assembly including a backrest, a seat joined to the backrest, and a legrest joined to the seat;

a pair of side frames disposed on opposite sides of the seat assembly, each side frame having a generally horizontal armrest which extends along one of said opposite sides of the seat assembly;

a seat support assembly pivotally suspending the seat assembly from the side frames and including a pair of seat supports affixed to said opposite sides of the seat assembly and pivotally mounted on the armrests;

a locking member pivotally mounted on each armrest and extending downwardly into juxtaposed relation to the respective seat support, each locking member being slidably connected to the respective seat support at a point located vertically higher than a lower surface of the seat; and a locking control connected to each locking member at the slidable connection thereof and actuatable to immobilize the slidable connection so as to lock the seat assembly in a desired position relative to the side frames.

2. The recliner chair of claim 1 wherein each locking member comprises an elongated locking bar having an upper end pivotally mounted on the respective armrest by a pivot pin and having a lower portion which includes a longitudinal slot therein, and wherein each locking mechanism further comprises a projecting member fixed to the respective seat support, the projecting member extending through the slot in the locking bar to define the slidable connection for the locking bar.

3. The recliner chair of claim 2 wherein the seat supports are pivotally mounted on the armrests by pivot members mounted on the armrests and the locking bars are pivotally mounted on the armrests at points which are spaced from the pivot members along the armrests in a direction toward the backrest of the seat assembly.

4. The recliner chair of claim 2 wherein each seat support comprises a generally rectangular frame including a first elongated plate member connected to a backrest ledge which engages the backrest and a second elongated plate member connected to a seat ledge which engages the seat, the first and second plate members having free ends joined to each other to define a corner of the rectangular frame, and a third plate member rigidly connected to the first and second plate members and pivotally connected to the respective armrest via one of the pivot members.

5. The recliner chair of claim 4 wherein each seat support further comprises a rectangular plate affixed to the rectangular frame, the backrest and seat ledges comprising edge portions of the rectangular plate which are bent inwardly for engaging the backrest and seat, respectively.

6. The recliner chair of claim 2 wherein the locking controls comprise clamps connected to the projecting members and actuatable to clamp against the locking bars for preventing relative movement between the locking bars and the seat supports.

7. The recliner chair of claim 6 wherein each clamp comprises a helically threaded member and the respective projecting member includes complementary helical threads for coacting with threads of the threaded member, the clamp further comprising a brake member which is clamped against the locking bar by rotating the threaded member relative to the projecting member.

* * * * *